US008677658B2

(12) United States Patent
Paull

(10) Patent No.: US 8,677,658 B2
(45) Date of Patent: Mar. 25, 2014

(54) ELONGATED NARROW TRENCHING SCOOP ATTACHMENT FOR A BACKHOE

(76) Inventor: Philip Paull, Noblesville, IN (US)

( * ) Notice: Subject to any disclaimer, the term of this patent is extended or adjusted under 35 U.S.C. 154(b) by 219 days.

(21) Appl. No.: 12/886,513

(22) Filed: Sep. 20, 2010

(65) Prior Publication Data

US 2012/0066941 A1 Mar. 22, 2012

(51) Int. Cl.
*E02F 9/28* (2006.01)

(52) U.S. Cl.
USPC ..... 37/444

(58) Field of Classification Search
USPC ..... 37/403–409, 466, 468, 444, 379, 443; 414/720–724, 685, 694; 172/245–253, 172/817
See application file for complete search history.

(56) References Cited

U.S. PATENT DOCUMENTS

| | | | | | |
|---|---|---|---|---|---|
| 2,416,409 | A * | 2/1947 | Schield | 37/444 |
| 2,783,558 | A * | 3/1957 | Morgan | 37/403 |
| 3,305,951 | A * | 2/1967 | Nunn | 37/367 |
| 4,133,121 | A * | 1/1979 | Hemphill | 37/444 |
| 4,719,711 | A * | 1/1988 | Sieber et al. | 37/444 |
| 4,903,418 | A * | 2/1990 | Loudon | 37/301 |
| RE33,198 | E * | 4/1990 | Ballinger | 37/444 |
| 5,833,008 | A * | 11/1998 | Reed et al. | 171/141 |
| 5,901,479 | A * | 5/1999 | Langdon | 37/444 |
| 6,067,733 | A * | 5/2000 | Gasper | 37/367 |
| 6,578,297 | B1 * | 6/2003 | Forsberg | 37/444 |
| 6,928,758 | B1 * | 8/2005 | Stout | 37/403 |

* cited by examiner

*Primary Examiner* — Robert Pezzuto
(74) *Attorney, Agent, or Firm* — C. John Brannon; Brannon Sowers & Cracraft PC

(57) ABSTRACT

An elongated digging attachment for an excavator, including a recessed main body portion, a connection assembly connected to the main body portion, and a ground engaging portion connected to the main body portion and oppositely disposed from the connection assembly. The recessed main body portion defines a concave curvature, the recessed main body portion and the ground engaging portion define a scoop, and the scoop has an aspect ratio of at least about 1:3.

17 Claims, 4 Drawing Sheets

ELONGATED NARROW TRENCHING SCOOP ATTACHMENT FOR A BACKHOE

TECHNICAL FIELD

The present novel technology relates generally to the field of mechanical engineering, and, more particularly, to an apparatus for enabling a backhoe to dig narrow trenches and a method for using the same.

BACKGROUND

The backhoe is one of the most versatile digging tools around. Backhoes can be maneuvered into position in places to dig where other excavation machines cannot go. The digging apparatus of the backhoe includes a hinged and hydraulically driven armature to which a generally semicircular bucket is hingedly connected. Backhoe buckets tend to be about 2 feet wide and connect to the manipulating armature at a like-sized connection plate. This means that ditches and trenches dug with a backhoe have a minimum width of about 2 feet. Bucket extensions and attachments, such as teeth, allow for narrower trenches, but only to limited depths equal to the length of the teeth. Further, as conventional backhoe buckets are scaled smaller, digging operations become less efficient, since after each digging stroke, the bucket must be lifted out of the trench, the armature pivoted away from the open trench, the bucket emptied, and the armature pivoted back into the trench for the next stroke. Additionally, as the bucket is scaled smaller, the problem of dirt packing the bucket becomes more acute, resulting in more difficulty in emptying the bucket after each pass.

There are many situations calling for deep and narrow trenches that a backhoe equipped with a conventional bucket or even a modified bucket just can't address. These trenches must be dug by other means. There are specialized excavation machines designed for digging deep, narrow trenches, such as belt or chain trenchers. While these tools accomplish the task of digging deep, narrow trenches, they are expensive, prone to frequent breakdown, and their use necessitates the purchase or rental of specialized equipment by the contractor, often for one relatively short dig.

Thus, there is a need for an apparatus that would take advantage of the versatility of a backhoe system for excavating narrow trenches. The present novel technology addresses this need.

SUMMARY

The present novel technology relates to a method and apparatus for digging deep and narrow trenches with a backhoe. One object of the present novel technology is to provide an improved backhoe scoop for digging narrow trenches. Related objects and advantages of the present novel technology will be apparent from the following description.

DETAILED DESCRIPTION OF THE PREFERRED EMBODIMENT

Figure 1:
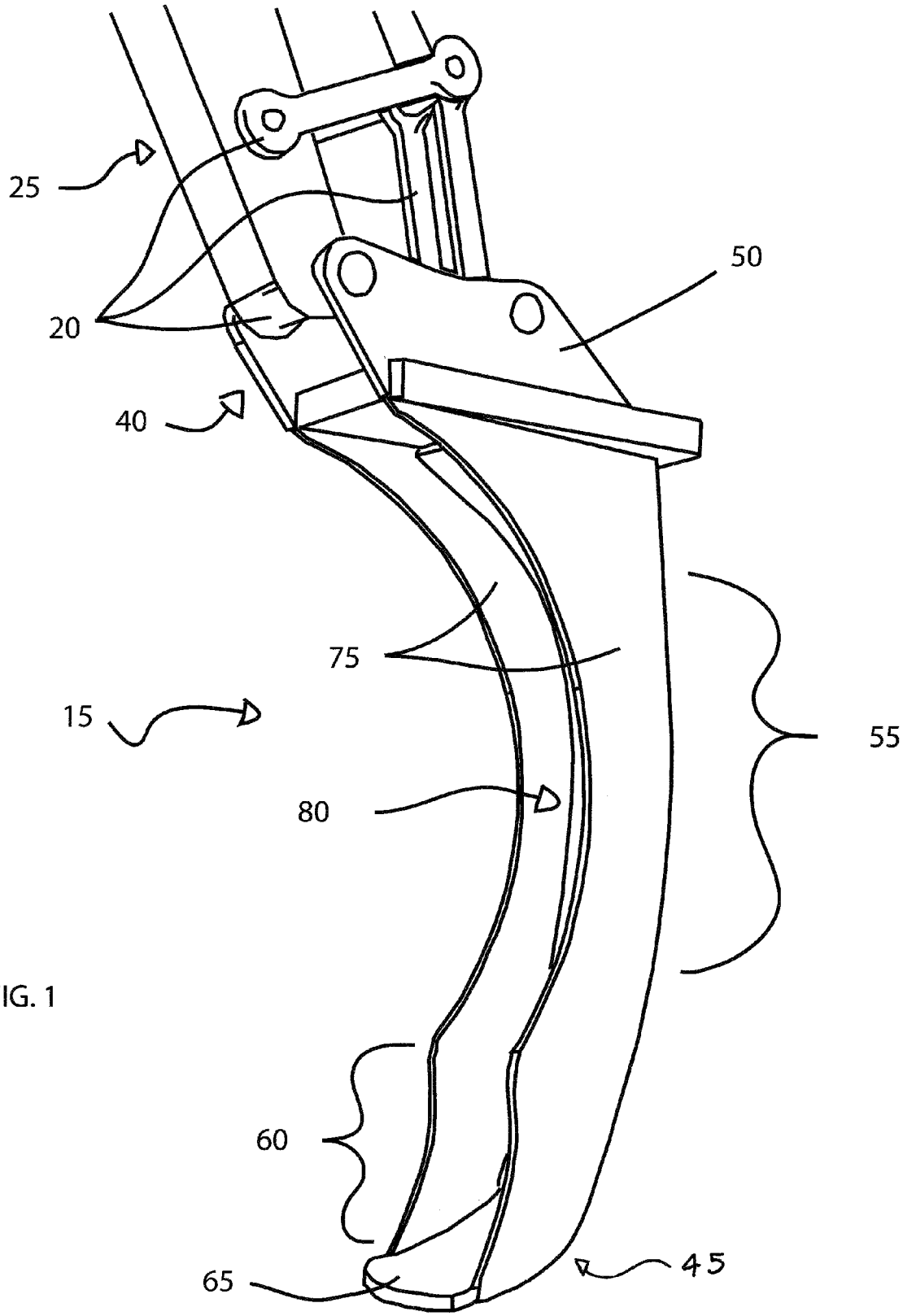
FIG. 1 is a perspective view of a first embodiment of the present novel technology, an elongated scoop for digging relatively deep and narrow trenches with a backhoe.
Figure 2:
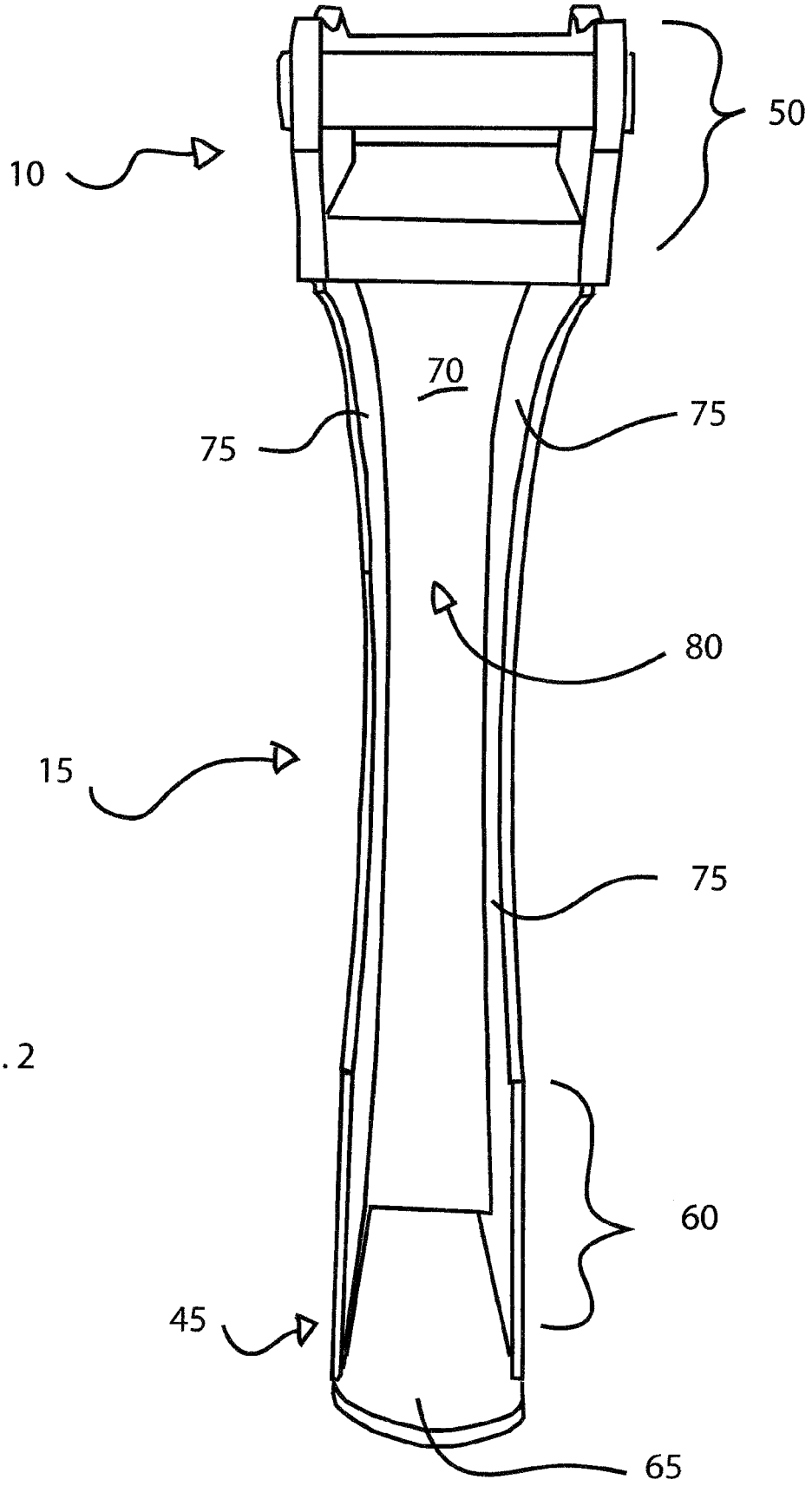
FIG. 2 is a front elevation view of the scoop of FIG. 1.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A typical backhoe, track hoe or like excavator includes a hinged armature or boom having a connection plate or assembly at the far end. The connection assembly typically includes one or more connection members and a set of pins for engaging a bucket. The connection members and pins are typically more that 12 inches long. The bucket is typically generally semicircular or semi-ovoid in shape. For semi-ovoid buckets, the short axis is the bisector. Buckets are designed to scoop out and retain a maximum load of dirt, gravel or the like. The backhoe operates by driving the teeth or leading edge of the bucket into the dirt or other medium to be excavated or moved, driving the bucket forward to fill it, pivoting the bucket into a mouth-up position, lifting the bucket out of the excavation, pivoting the armature away from the excavation, pivoting the bucket into a mouth-down position, emptying the bucket, pivoting the armature back to the excavation, and repeating the process. The minimum width of an excavation is the width of the pins and connection members and/or the armature, and, for smaller buckets, the maximum depth is the bucket height.

The present novel technology allows for the digging of narrower trenches with a backhoe, and also for a much faster, more efficient digging technique. A first embodiment of the present novel technology is illustrated in FIGS. 1-4, a backhoe trenching system 10 for digging relatively narrow (typically from about 4 inches wide to about 18 inches wide) and relatively deep (about 3 feet or deeper) trenches. The system 10 includes an elongated scoop 15 connectable to the connection plate or assembly 20 at the end of the digging armature 25 of an excavator 30, such as a backhoe, trackhoe or the like. The scoop 15 is elongated with a slight curvature and generally has the shape of a jai alai scoop. In other words, the elongated scoop 15 is generally comma-shaped. In one embodiment, the scoop 15 is about 4 feet long and about 12 inches wide, although scoops 15 may have other dimensions. The scoop 15 is typically made of a structural material, such as steel.

The scoop 15 is a generally elongated member having a proximal end 40 and a distal end 45. The scoop 15 typically terminates in a coupling or connection assembly 50 at proximal end 40. The scoop 15 typically includes a recessed main body portion 55 extending from the proximal end 40 and which typically connects to a ground engaging portion 60 at the distal end 45. The ground engaging portion 60 typically includes a tooth 65 extending therefrom for engaging the ground during the digging operation. Tooth 65 is typically formed as an extension of the rear wall or back plate 70 of the scoop 15, but may be a separate member. A pair of oppositely disposed generally parallel side walls or plates 75 extend from back plate 70 to define an elongated recess 80. Typically, the side plates 75 are respectively disposed perpendicular to back plate 70. The main body portion 55 typically has a moderate concave curvature, while the ground engaging portion 60 typically has only a slight curvature, if curved at all, such that soil or clay dislodged by the ground engaging portion 60 is urged toward and into the main body portion 55, where the curvature of the rear wall 70 guides the soil and/or clay upwardly and outwardly at the proximal end 40.

Figure 3:
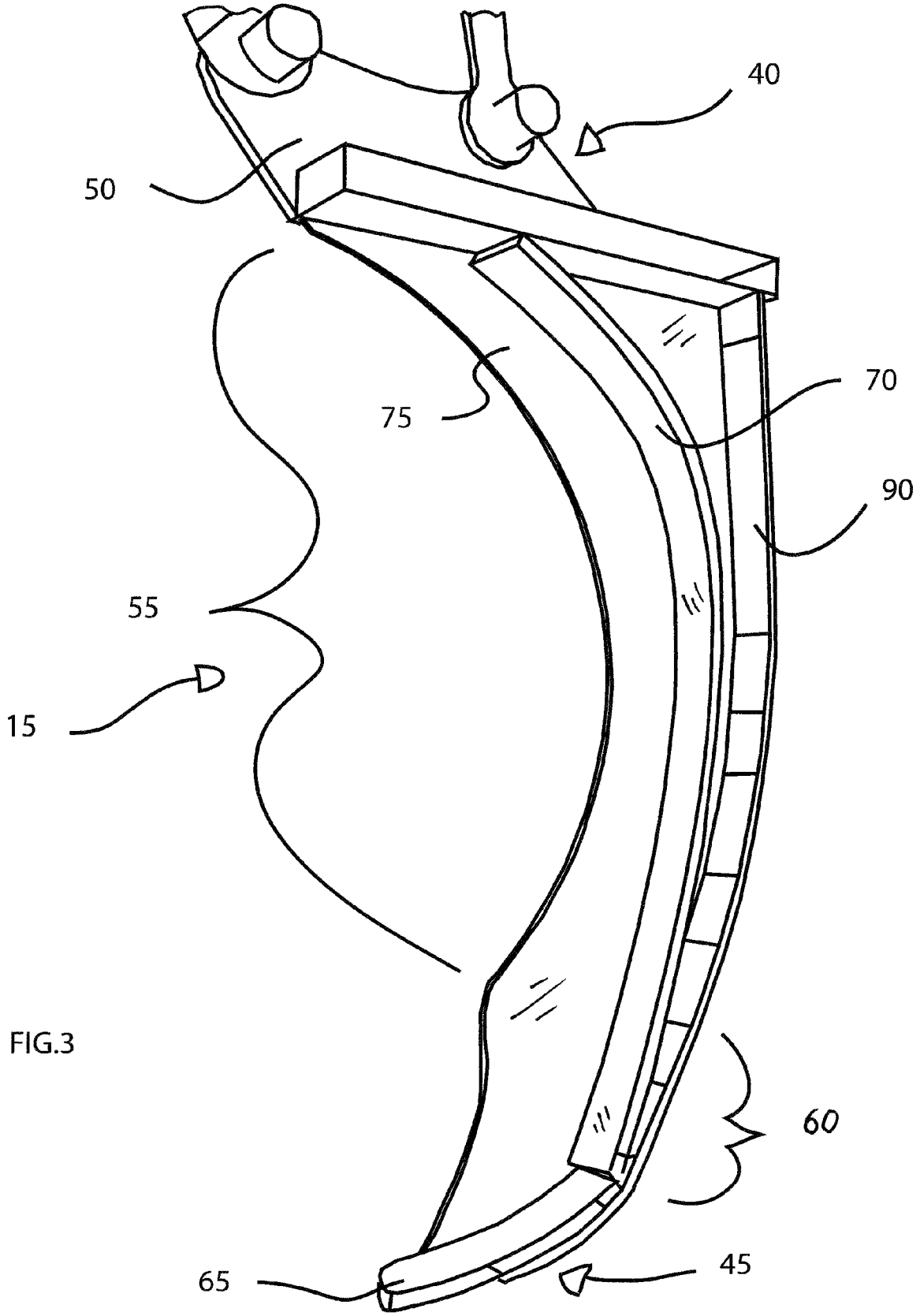
FIG. 3 is a perspective cutaway view of the scoop of FIG. 1.
Figure 4:
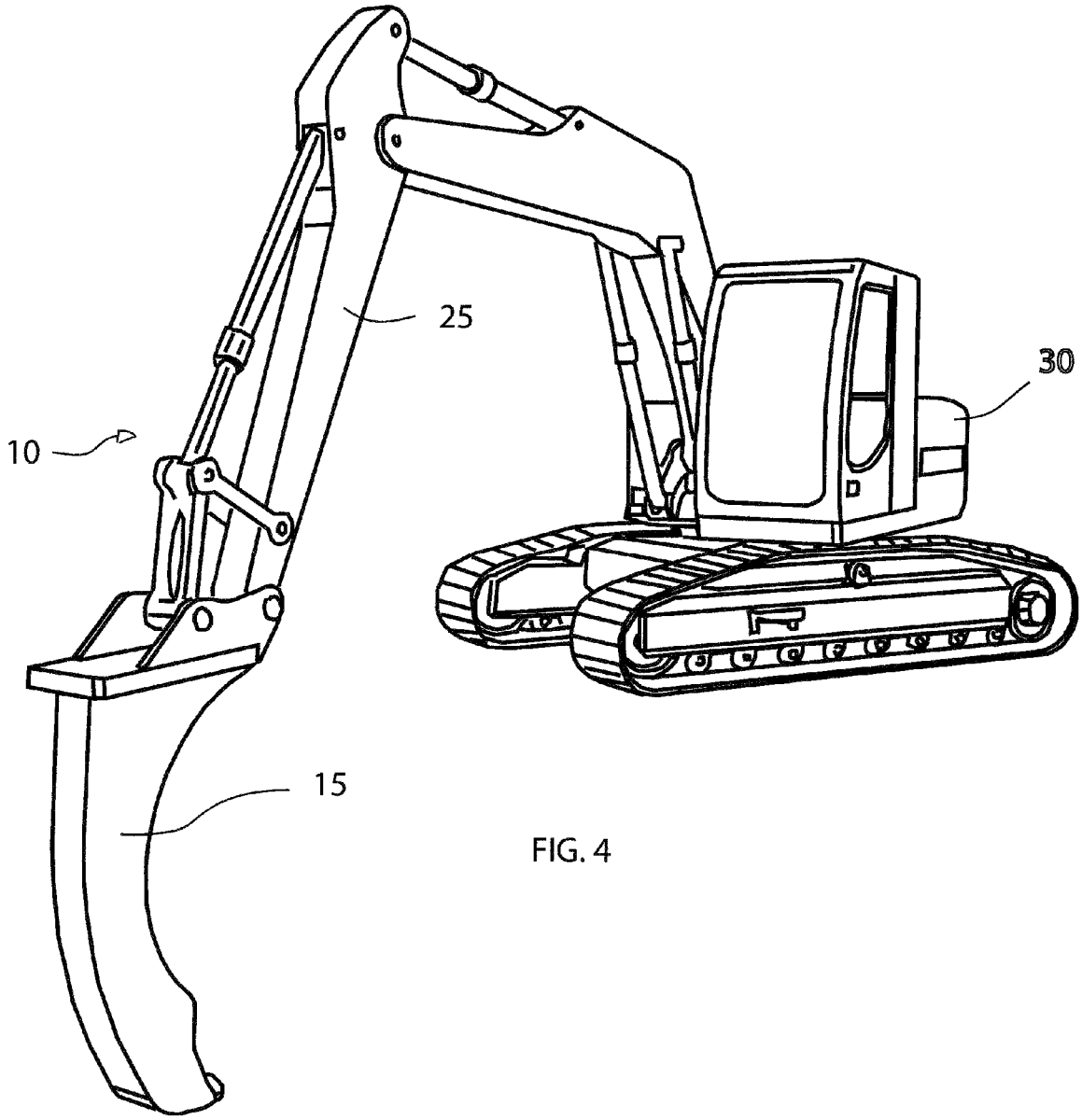
FIG. 4 is a perspective view of the scoop and backhoe of FIG. 2.

In some embodiments, the back plate and the rear wall 70 are unitary, while in other embodiments the rear wall 70 is a member positioned in the scoop 15 to define the elongated recess 80 and a separate back plate 90 connects to side plates 75 to complete the scoop 15 (see FIG. 3). The rear wall member 70 is typically generally flat extending from the distal end 45 into the main body portion 55, and typically curves as it approaches the proximal end 40 to guide soil and/or clay from the distal end 45 through the main body portion 55 and out of the recess 80 at the proximal end 40.

Typically, the scoop 15 has an aspect ratio (width to length) of at least about 1:3; more typically of at least about 1:9, and still more typically of at least about 1:12.

In operation, the scoop 15 is operationally connected to the boom or digging armature 25 of the backhoe 30 at the connection assembly 20. The backhoe 30 then positioned, and the scoop 15 is engaged with the ground. The scoop 15 is brought forward (toward the backhoe 30) while downward pressure is applied. Earth is dislodged and forced up into the scoop 15, where it curls forward and exits the scoop 15 ahead of its forward path. The freshly dislodged dirt is thus pushed ahead of the scoop 15 and up and out of the forming trench, where it either falls aside the excavation or piles up at the near the end of the excavation. After the scoop 15 is brought forward, it is lifted slightly and moved back to the far end of the excavation. In other words, the armature 25 is first extended relatively straight such that the scoop 15 is moved away from the backhoe 30, the scoop 15 is engaged with the ground, and the armature 25 is then hingedly retracted to draw the scoop 15 through the ground towards the backhoe 30, defining an excavation. This process is then repeated, without the need of swiveling the armature 25 to empty a bucket. In other words, a narrow, deep trench is scratched out by the elongated scoop 15 with the excavated soil pushed up and out of the scoop 15 and forced aside. After a particular length of trench is dug, the backhoe 30 is repositioned, the scoop 15 is turned sideways and used to brush excavated soil away from the new dig site, and the process is repeated.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A trenching attachment for an excavator, comprising:
an elongated curved rear wall;
a pair of oppositely disposed curved side walls connected to the rear wall and defining an elongated recess;
a tongue portion connected to the rear wall and extending from the recess; and
a connection assembly for engaging an excavator armature operationally connected to the elongated curved rear wall and oppositely disposed from the tongue portion;
wherein the elongated recess has an aspect ratio of at least about 1:3.

2. The trenching attachment of claim 1 wherein the elongated recess has an aspect ratio of at least about 1:9.

3. The trenching attachment of claim 1 wherein the elongated recess has an aspect ratio of at least about 1:12.

4. An elongated digging attachment for an excavator, comprising:
a recessed main body portion,
a connection assembly connected to the main body portion; and
a ground engaging portion connected to the main body portion and oppositely disposed from the connection assembly;
wherein the recessed main body portion defines a concave curvature;
wherein the recessed main body portion and the ground engaging portion define a scoop; and
wherein the scoop has an aspect ratio of at least about 1:3.

5. The trenching attachment of claim 4 wherein the scoop has an aspect ratio of at least about 1:9.

6. The trenching attachment of claim 4 wherein the scoop has an aspect ratio of at least about 1:12.

7. The trenching attachment of claim 4 and further including a back plate connected to a pair of oppositely disposed sidewall portions and defining the scoop.

8. The trenching attachment of claim 7 and further comprising a curved rear wall portion disposed in the scoop and extending between the pair of oppositely disposed sidewall portions.

9. An apparatus for digging trenches, comprising:
a recessed elongated scoop member, wherein the recessed elongated scoop member further includes a proximal main body portion and a distal ground engaging portion;
a coupling assembly connected to the proximal main body portion; and
a tooth extending from the distal ground engaging portion;
wherein the scoop is generally comma-shaped; and, wherein the recessed elongated scoop member has an aspect ratio of at least about 1:3.

10. The apparatus of claim 9 and further comprising an elongated rear wall portion connected to a pair of oppositely disposed sidewall portions and defining the recessed elongated scoop member.

11. The apparatus of claim 10 wherein the elongated rear wall portion is concavely curved in the proximal main body portion.

12. The apparatus of claim 9 and further comprising an excavator operationally connected to the coupling assembly.

13. The apparatus of claim 12 wherein the excavator further comprises a boom arm extending therefrom and wherein the boom arm is operationally connected to the coupling assembly.

14. The apparatus of claim 12 wherein the excavator is a back hoe.

15. The apparatus of claim 12 wherein the excavator is a track hoe.

16. The apparatus of claim 9 wherein the recessed elongated scoop member has an aspect ratio of at least about 1:9.

17. The apparatus of claim 9 wherein the recessed elongated scoop member has an aspect ratio of at least about 1:12.

* * * * *